US011773560B2

(12) United States Patent
Sun et al.

(10) Patent No.: US 11,773,560 B2
(45) Date of Patent: Oct. 3, 2023

(54) POOR FOUNDATION REINFORCEMENT SYSTEM AND REINFORCEMENT METHOD BASED ON UNDERGROUND CONCEALED ARCH STRUCTURES

(71) Applicants: Shandong University, Jinan (CN); Shandong Hi-speed Group Co. Ltd., Jinan (CN)

(72) Inventors: Renjuan Sun, Jinan (CN); Chuan Wang, Jinan (CN); Yanhua Guan, Jinan (CN); Yonghao Li, Jinan (CN); Peizhi Zhuang, Jinan (CN); Huaqiang Yuan, Jinan (CN); Hongzhi Zhang, Jinan (CN); Linglai Bu, Jinan (CN); Yifan Li, Jinan (CN); Yuhe Tian, Jinan (CN); Lin Wang, Jinan (CN)

(73) Assignees: SHANDONG UNIVERSITY, Jinan (CN); SHANDONG HI-SPEED GROUP CO., LTD., Jinan (CN)

( * ) Notice: Subject to any disclaimer, the term of this patent is extended or adjusted under 35 U.S.C. 154(b) by 0 days.

(21) Appl. No.: 18/110,159

(22) Filed: Feb. 15, 2023

(65) Prior Publication Data

US 2023/0279632 A1 Sep. 7, 2023

(30) Foreign Application Priority Data

Mar. 1, 2022 (CN) ..... 202210192912.8

(51) Int. Cl.

| | |
|---|---|
| ***E02D 27/12*** | (2006.01) |
| ***E02D 5/50*** | (2006.01) |
| ***E02D 29/16*** | (2006.01) |

(52) U.S. Cl.

CPC ..... *E02D 27/12* (2013.01); *E02D 5/50* (2013.01); *E02D 29/16* (2013.01); *E02D 2300/002* (2013.01)

(58) Field of Classification Search

CPC .. E02D 27/12; E02D 5/50; E02D 5/46; E02D 5/34; E01D 4/00

See application file for complete search history.

(56) References Cited

FOREIGN PATENT DOCUMENTS

| | | | |
|---|---|---|---|
| CN | 10113092 A | * | 2/2008 |
| CN | 102304908 | * | 1/2012 |

(Continued)

OTHER PUBLICATIONS

Shandong University (Applicant), Preliminary Amendment for CN202210192912.8, w/ (allowed) replacement claims, dated Aug. 16, 2022.

(Continued)

*Primary Examiner* — Sunil Singh

(74) *Attorney, Agent, or Firm* — Zhigang Ma

(57) ABSTRACT

A poor foundation reinforcement system and a reinforcement method based on underground concealed arch structures are provided. The system and the method belong to the technical field of poor foundation treatment. The reinforcement system includes multiple columns of pile foundations arranged along a bridge direction. Multiple arch sheets are set in parallel between each two adjacent columns of pile foundations. Each arch sheet includes multiple high-pressure rotary jet piles arranged along the bridge. Each two adjacent arch sheets of the multiple arch sheets are connected by a micro-bending slab disposed on the two adjacent arch sheets, the multiple arch sheets are connected by the micro-bending slabs to together form an arch ring, and a construction joint is disposed between each two adjacent micro-bending slabs of the micro-bending slabs.

6 Claims, 4 Drawing Sheets

(56) References Cited

FOREIGN PATENT DOCUMENTS

| | | | | |
|---|---|---|---|---|
| CN | 102304908 | A | * | 1/2012 |
| CN | 103388341 | A | * | 11/2013 |
| CN | 104499413 | | * | 4/2015 |
| CN | 106894327 | | * | 6/2017 |
| CN | 107893367 | | * | 4/2018 |
| CN | 108166380 | | * | 6/2018 |
| CN | 108330808 | | * | 7/2018 |
| CN | 109487640 | A | * | 3/2019 |
| CN | 111475880 | | * | 7/2020 |
| CN | 111851317 | | * | 10/2020 |
| CN | 112411346 | | * | 2/2021 |
| CN | 112796198 | | * | 5/2021 |

OTHER PUBLICATIONS

CNIPA, Notification to grant patent right for invention in CN202210192912.8, dated Aug. 25, 2022.

* cited by examiner

POOR FOUNDATION REINFORCEMENT SYSTEM AND REINFORCEMENT METHOD BASED ON UNDERGROUND CONCEALED ARCH STRUCTURES

TECHNICAL FIELD

The disclosure relates to a poor foundation reinforcement system and a reinforcement method based on underground concealed arch structures, which belongs to the technical field of poor foundation treatment.

BACKGROUND

In the process of highway construction, it is unavoidable to encounter various poor foundation conditions. Soft soil foundation and karst foundation are two common poor foundations. The soft soil foundation is characterized by low strength, high compressibility, large thickness and poor permeability. The karst foundation has poor stability and insufficient bearing capacity therefore it has high risk of collapse. Subgrade and pavement construction on the untreated poor foundation will cause problems such as excessive foundation deformation, differential settlement, poor pavement flatness and subsidence. Even worse, cracks may occur in bridges, tunnels and other structures, which greatly threaten the driving safety. Therefore, it is very necessary to treat the poor foundation to control the settlement and improve the foundation stability, thus ensuring successful highway construction and guaranteeing driving safety.

At present, several methods are commonly used to reinforce poor foundation, including surcharge preloading, chemical reinforcement, soil replacement, cast-in-place pile and dynamic compaction. These methods are applicable to various conditions. The surcharge preloading is easily conducted and the technology is mature, but soft soil needs a longer consolidation period, it is not suitable for some projects with tight construction period. The chemical reinforcement can quickly strengthen soft soil subgrade, but the cost is too high to control the project cost. The soil replacement requires a lot of excavation and filling, which has a great negative impact on the environment along the construction line and is easy to damage the environment. The construction of cast-in-place pile is difficult, the required materials are expensive, and the construction period is long. The above methods are only applicable to specific soil conditions and geological environment. All of them have high requirements for construction conditions.

SUMMARY

For shortcomings of the prior art, the disclosure provides a poor foundation reinforcement system and a reinforcement method based on underground concealed arch structures, high-pressure rotary jet piles are used for construction of the pile foundation and arch ring of concealed arch structures to solve the problem of insufficient bearing capacity of the poor foundation. The construction has low noise, few construction restrictions, wide application scope and low cost. At the same time, the construction difficulty can be effectively reduced, and the construction period can be shortened.

1. High-pressure rotary jet pile is a kind of high-pressure jet grouting method. During the construction process, a grouting pipe with a special nozzle is inserted into a designed soil depth, and then high-pressure cement paste is injected from the nozzle to cut the soil. Under strong power of the high-pressure jet flow, the soil is damaged, and soil particles are peeled off from the soil layer and mixed with the cement paste to form a mixed slurry. Some of the fine soil particles rise out of the ground with the mixed slurry. The rest of the soil particles are rearranged according to a certain ratio of the cement paste to the soil under the impact force, centrifugal force, gravity and other forces of the high-pressure jet flow. In this way, continuous jet grouting is carried out from bottom to top. After the mixed slurry solidifies, columnar consolidation bodies with certain strength are formed in the soil layer.

2. Micro-bending slab: a force bearing element that is slightly bent into an arch shape. In this disclosure, a micro-bending bottom of the slab is designed. Technical solutions of the disclosure are as follows.

A poor foundation reinforcement system based on underground concealed arch structures includes multiple columns of pile foundations arranged along a bridge direction (also referred to a direction of the central axis of a bridge, the bridge represents a large structure used to cross obstacles, and the bridge is the poor foundation reinforcement system in the disclosure). Multiple arch sheets are set in parallel between each two adjacent columns of pile foundations (a distance between the adjacent columns of pile foundations is a single span). Each arch sheet includes multiple high-pressure rotary jet piles arranged along the bridge direction.

Each two adjacent arch sheets of the multiple arch sheets are connected by a micro-bending slab disposed on the two adjacent arch sheets, the multiple arch sheets are connected by the micro-bending slabs to together form an arch ring for bearing a load on the arch ring, and a construction joint is disposed between each two adjacent micro-bending slabs of the micro-bending slabs.

Preferably, the multiple arch sheets are arranged in parallel along a transverse bridge direction (a direction perpendicular to the central axis of the bridge). The number of the multiple arch sheets and spacing between two arch sheets in the transverse bridge direction can be determined by stress conditions of a bridge. The lengths of high-pressure rotary jet piles of the multiple arch sheets at a same position along the transverse bridge direction are the same, that means the lengths of the high-pressure rotary jet piles along the transverse bridge direction are the same. For each of the arch sheets along the bridge direction, lengths of high-pressure rotary jet piles are different and the form of an arch axis of the high-pressure rotary jet piles along the bridge direction is a catenary, which can reduce bending moment generated by a section of the arch ring. The number of arch sheets is determined by the number of the high-pressure rotary jet piles in the transverse bridge direction.

Preferably, the diameter of each high-pressure rotary jet pile is in a range of 0.6-0.8 meters (m).

Preferably, the pile foundations and the arch ring are connected in an embedded manner, and high-pressure rotary jet piles on both sides of the arch ring are driven into the pile foundations and connected rigidly.

The design method of the arch ring includes an arch axis design of the arch ring, a material selection of the high-pressure rotary jet piles and a span calculation and a design of working conditions. The arch axis of arch ring is designed as a catenary. With a form of the catenary, the bridge is only affected by its own weight, which can effectively avoid the bending moment of the arch ring. The material of each of multiple the high-pressure rotary jet piles forming the arch ring is an ordinary Portland cement with a strength grade not less than 42.5 megapascals (MPa), and the ordinary Portland cement is mixed with soil to form cement soil. An ultimate span is calculated and designed by referring to a deck type hingeless concrete arch bridge.

High-pressure rotary jet grouting is used for construction of the high-pressure rotary jet piles. A drilling rig is used to penetrate a soft soil layer. After the drilling rig reaches a predetermined depth, a grouting pipe inside the drill rig sprays cement paste at high pressure of 20-30 MPa to scour surrounding soil, which makes the soil broken and mixed with the cement paste to form a consolidated body, thereby enhancing the bearing capacity of the soil.

Preferably, the micro-bending slab is a prefabricated reinforced concrete slab, and the lower part of the micro-bending slab facing toward the two adjacent arch sheets is arched, which can effectively reduce weight of the micro-bending slab. The width of supporting parts on both sides of a bottom of the micro-bending slab is calculated by an arch radius minus a width of an expansion joint. Steel bars in the micro-bending slab include longitudinal load-bearing steel bars and stirrups. The number of the steel bars is determined by specific stress conditions.

Preferably, each pile foundation of the multiple columns of pile foundations is a high-pressure rotary jet pile foundation. For a soil layer with a thickness not greater than 35 m and a strong rock layer below, the bottom of the pile foundation is disposed on the rock formation. For the soil layer with a thickness greater than 35 m, the pile foundation is designed as a friction pile.

Taking the high-pressure rotary jet piles as a base, the arrangement of the high-pressure rotary jet piles, diameters of the high-pressure rotary jet piles, pile lengths of the high-pressure rotary jet piles are determined according to the upper load, geological conditions and strengths of the high-pressure rotary jet piles.

The design of the pile foundations mainly includes the selection of diameters of the pile foundations, the design for distances between each two pile foundations along the transverse bridge direction, and the connection manner between the pile foundations and the arch sheet. An optimum range of a diameter of the pile is 0.6-0.8 m. Various pile arrangements can be designed to calculate an allowable bearing capacity of a composite foundation and obtain the distance between piles. High-pressure rotary jet piles on both sides of the arch ring are driven into the pile foundations for a rigid connection.

A reinforcement method for the poor foundation reinforcement system based on underground concealed arch structures includes following steps:

step 1: pile foundation construction, including: determining a location of drilling holes, a diameter of a pile foundation, and a depth of the pile foundation into soil according to a construction design;

step 2: determining diameters of high-pressure rotary jet piles forming the arch ring, a number of the high-pressure rotary jet piles forming the arch ring disposed along the transverse bridge direction and a center distance of two high-pressure rotary jet piles, performing high-pressure rotary jet pile construction on the arch ring to make the arch axis of the arch ring to be the catenary;

step 3: connecting the pile foundations and the arch ring in the embedded manner, and using a drill machine to drive the high-pressure rotary jet piles on both sides of the arch ring into the pile foundation by a depth of 2 m to form a hingeless arch structure;

step 4: preparing micro-bending slabs in factories, C25 concrete is selected as a main material of the micro-bending slabs, and a shape of the micro-bending slabs can reduce weight and improve stress conditions of the arch ring; filling soil before installation of the micro-bending slabs, installing the micro-bending slabs after filling the soil, setting up the construction joint between each two adjacent micro-bending slabs, and filling the concrete in the construction joint;

where the arch sheets and micro-bending slabs are combined to form a double curved arch structure: the micro-bending slabs are placed on the arch sheets, and the construction joint is filled with the concrete, which is conducive to bearing the load and realizing a purpose of longitudinally crossing a poor foundation section; and step 5: paving bitumen pavement on the micro-bending slabs, adding crash barriers, and setting up road signs.

Since a connection manner of the micro-bending slabs composed of steel bars and concrete is used in the disclosure, the pavement structure can be simplified to an asphalt mixture layer without base and subbase.

Preferably, the high-pressure rotary jet pile construction in step 2 includes:

step 2.1: leveling site, surveying and setting out;

step 2.2: drilling holes using a method of pile jumping construction after determining a location, numbering the high-pressure rotary jet piles, every three of the high-pressure rotary jet piles along a length direction (i.e., the bridge direction) being a sequence, performing construction of a next sequence after completing construction of a same sequence; where the pile jumping construction can avoid the strength reduction caused by the interaction of the high-pressure rotary jet piles;

step 2.3: cleaning the drilled holes; spraying cement after cleaning the drilled holes, where the cement is the ordinary Portland cement with a strength grade not less than 42.5 MPa and a density not less than 500 kg/m, a water cement ratio of cement paste of the ordinary Portland cement is 1:1; a water pressure increases from small to a predetermined pressure during drilling the holes; performing jet grouting using double pipe injection when the holes are drilled to a designated elevation; and grouting the cement paste and air simultaneously using a jet pump; a pressure of the jet pump is not less than 20 MPa, and an air flow pressure is not less than 0.7 MPa;

step 2.4: stopping grouting the cement paste immediately in case of grout spilling during the high-pressure rotary jet pile construction, and continue to perform the construction after initial setting of the cement paste; and step 2.5: using an overall construction sequence to perform the high-pressure rotary jet pile construction, where the overall construction sequence includes: constructing the pile foundations first, then constructing the arch sheets on both sides of the pile foundations, and finally constructing remaining arch sheets from the both sides of the pile foundations.

Where the disclosure is not described in detail, the prior art can be adopted.

Based on advantages of the arch structure, such as excellent stress performance and strong spanning capacity, the disclosure provides a poor foundation reinforcement system and a reinforcement method based on underground concealed arch structures. The method uses high-pressure rotary jet piles to perform high-pressure rotary jet pile construction and arch ring construction of the concealed arch structures, a material strength of the high-pressure rotary jet piles is determined by a dosage of cementitious material per linear meter, and the material strength is up to 5-10 MPa. The construction has low noise, few construction restrictions, wide application scope and low cost. At the same time, the construction difficulty can be effectively reduced, and the construction period can be shortened.

Beneficial effects of the disclosure are as follows:

1) The disclosure uses high-pressure rotary jet piles to construct underground arch structures for crossing a poor foundation, which improves the engineering efficiency and is applicable to various working conditions, and the workload of designs is reduced.

2) The high-pressure rotary jet piles of the disclosure are combined to form multiple arch sheets, which has excellent bearing capacity and can meet the engineering requirements. The multiple arch sheets are combined into an arch ring through upper bridge decks (i.e., micro-bending slabs), and an arch axis of the arch ring is a catenary, which is conducive to improving the spanning capacity of the arch bridge.

3) The disclosure combines the high-pressure rotary jet piles to form the pile foundations. There is no space between the high-pressure rotary jet grouting piles of the same pile foundation. Two columns of high-pressure rotary jet piles are disposed as side span pile foundations along the transverse bridge direction, and three columns of pile foundations are disposed as pile foundations at the combination part of two adjacent spans. When the high-pressure rotary jet piles forming the arch ring are constructed, the high-pressure rotary jet piles are driven into the pile foundations to form a hingeless arch structure, which can effectively reduce the material consumption, reduce the project cost, and avoid the inconvenience caused by multiple construction methods.

4) By setting the arch ring in soil foundation, the stability of the arch ring can be significantly improved. Besides, the soil under the arch ring can also play a certain supporting role for the arch ring. The disclosure does not need to check the stability of the arch ring separately, only need to check a material strength of the arch ring.

BRIEF DESCRIPTION OF DRAWINGS

FIG. 7 (*b*) is a structural diagram II of the prefabricated micro-bending slab composed of reinforced concrete.

FIG. 7 (*c*) is a structural diagram III of the prefabricated micro-bending slab composed of reinforced concrete.

DESCRIPTION OF REFERENCE NUMERALS

Figure 1:
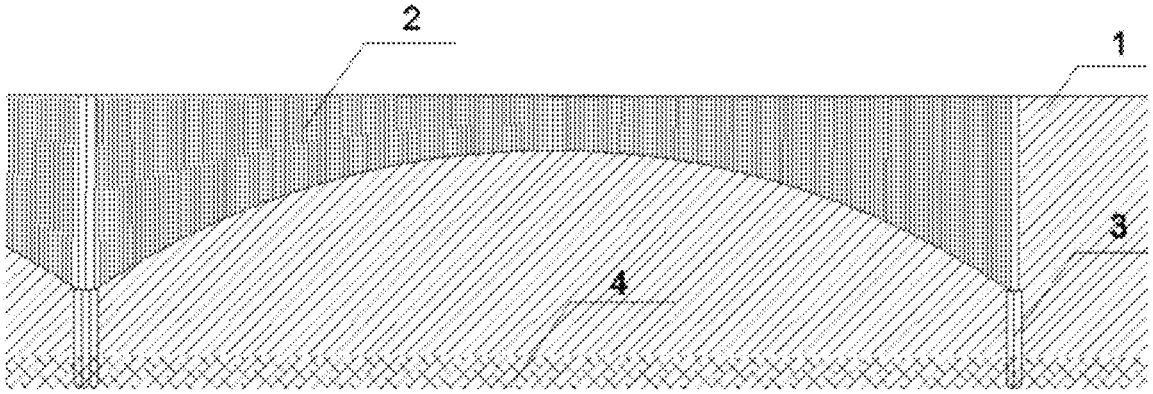
FIG. 1 is a vertical section of a side span of an underground concealed arch structure.
Figure 2:
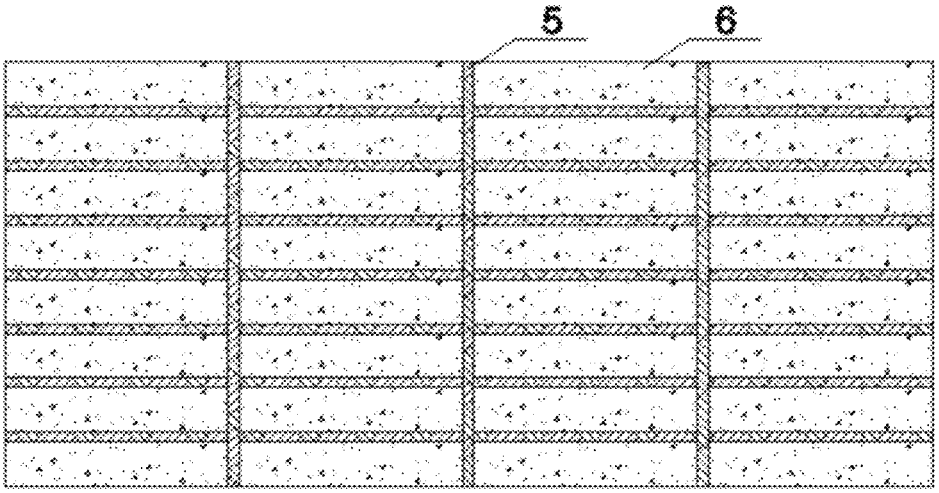
FIG. 2 is a single span plan view of a concealed arch.

1—natural soil; 2—high-pressure rotary jet piles forming an arch ring; 3—high-pressure rotary jet piles forming a pile foundation; 4—rock formation; 5—construction joint; 6—micro-bending slab; 7—filled soil; 8—transverse bridge direction; 9—bridge direction; 10—high-pressure rotary jet piles of a same sequence; 11—arch axis; 12—combined structure of pile foundations and arch ring; 13—concrete; 14—longitudinal load-bearing steel bar; 15—stirrup; 16—bitumen pavement.

DETAILED DESCRIPTION OF EMBODIMENTS

In order to make technical problems, technical solutions and advantages to be solved by the disclosure clearer, the following will be described in detail in combination with attached drawings and specific embodiments, but not limited to this. Those not described in detail by the disclosure are based on conventional technologies in the field.

Embodiment 1

A poor foundation reinforcement system based on underground concealed arch structures as shown in FIG. 1-FIG. 8, the poor foundation reinforcement system includes multiple columns of pile foundations arranged along a bridge direction 9. Multiple arch sheets are set in parallel between each two adjacent columns of pile foundations. Each arch sheet includes multiple high-pressure rotary jet piles arranged along the bridge direction 9.

Each two adjacent arch sheets of the multiple arch sheets are connected by a micro-bending slab 6 disposed on the two adjacent arch sheets, the multiple arch sheets are connected by the micro-bending slabs 6 to together form an arch ring for bearing a load on the arch ring, and a construction joint 5 is disposed between each two adjacent micro-bending slabs 6 of the micro-bending slabs 6.

The multiple arch sheets are arranged in parallel along a transverse bridge direction 8, a number of the multiple arch sheets and spacing between two arch sheets of the multiple arch sheets in the transverse bridge direction 8 can be determined by stress conditions of a bridge, lengths of high-pressure rotary jet piles of the multiple arch sheets at a same position along the transverse bridge direction 8 are the same, that means lengths of the high-pressure rotary jet piles along the transverse bridge direction 8 are the same, for each of the arch sheets along the bridge direction 9, lengths of high-pressure rotary jet piles of the arch sheet along the bridge direction 9 are different (the high-pressure rotary jet piles forming an arch ring 2 as shown in FIGS) and a form of an arch axis 11 of the high-pressure rotary jet piles of the arch sheet along the bridge direction 9 is a catenary, which can reduces bending moment generated by a section of the arch ring, and the number of arch sheets is determined by the number of the high-pressure rotary jet piles in the transverse bridge direction 8.

A diameter of each of the multiple high-pressure rotary jet piles of each of the multiple arch sheets is in a range of 0.6-0.8 m.

Figure 6:
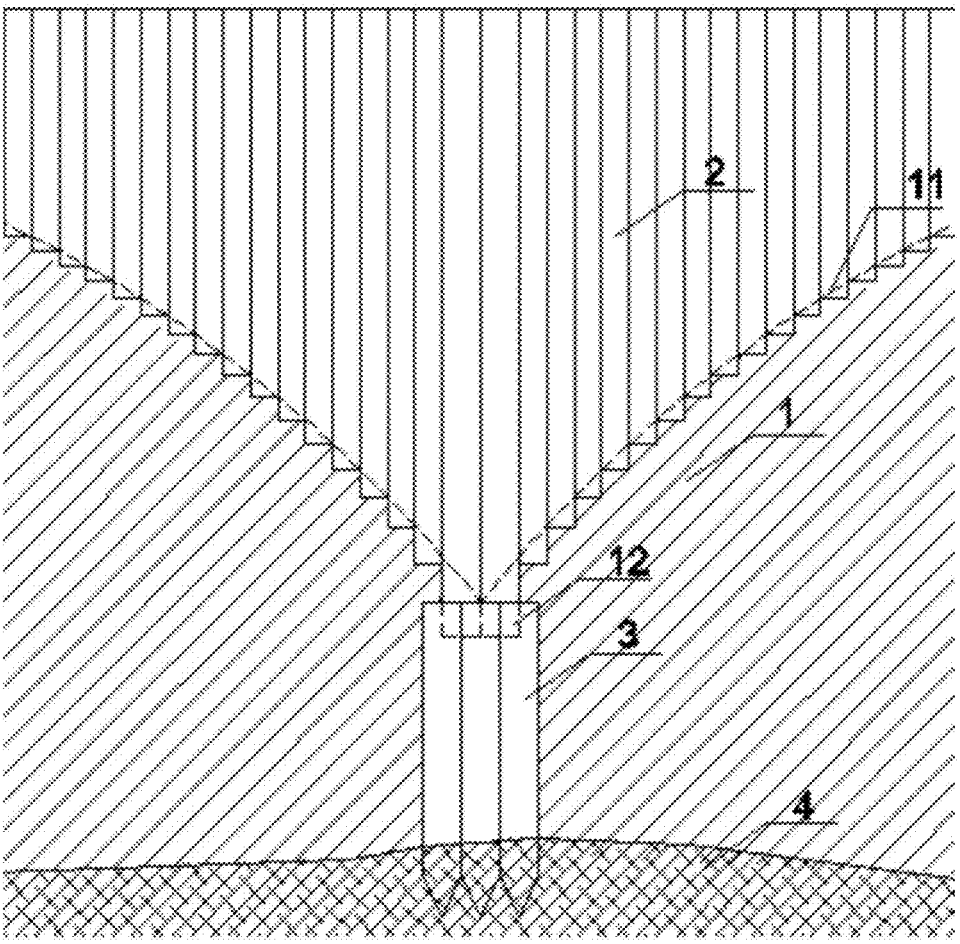
FIG. 6 shows a connection relationship of pile foundations and arch rings.

The two adjacent columns of pile foundations of the multiple columns of pile foundations and the arch ring are connected in an embedded manner. High-pressure rotary jet piles on both sides of the arch ring are driven into and connected rigidly to the two adjacent columns of pile foundations of the multiple columns of pile foundations, thereby forming a combined structure of pile foundations and arch ring 12 as shown in FIG. 6.

In the disclosure, among the high-pressure rotary jet piles forming the arch ring 2, each of the high-pressure rotary jet piles whose bottom is connected to the pile foundation directly has a larger diameter, the larger diameter is preferably 0.8 m. Other high-pressure rotary jet piles whose bottoms are placed on natural soil 1 have smaller diameters, each of the smaller diameters is preferably 0.6 m. All the high-pressure rotary jet piles forming the arch ring 2 are connected by the micro-bending slabs 6 disposed on the arch ring.

For a design method of the arch ring, it includes an arch axis design of the arch ring, a material selection of the high-pressure rotary jet piles, a span calculation and a design of working conditions. The arch axis 11 of arch ring is designed as a catenary. Under a form of the catenary, the bridge is only affected by its own weight, which can effectively avoid the bending moment of the arch ring. A material of each of multiple the high-pressure rotary jet piles forming the arch ring 2 is an ordinary Portland cement with a strength grade not less than 42.5 MPa, and the ordinary Portland cement is mixed with soil to form cement soil. An ultimate span is calculated and designed by referring to a deck type hingeless concrete arch bridge.

High-pressure jet grouting is used for construction of the high-pressure rotary jet piles. A drilling rig is used to penetrate a soft soil layer. After the drilling rig reaches a predetermined depth, a grouting pipe inside the drill rig sprays cement paste at high pressure of 20-30 MPa to scour surrounding soil body, which makes the soil body is broken and mixed with the cement paste to form a consolidated body, thereby enhancing the bearing capacity of the soil body and enabling the soil foundation can bear an upper load.

Figure 7:
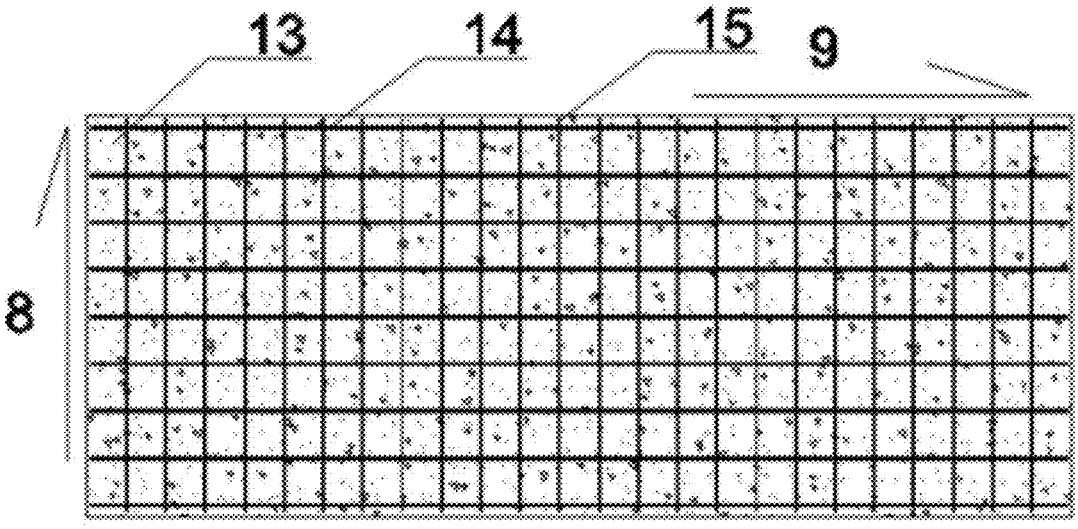
FIG. 7 (*a*) is a structural diagram I of a prefabricated micro-bending slab composed of reinforced concrete.
Figure 7:
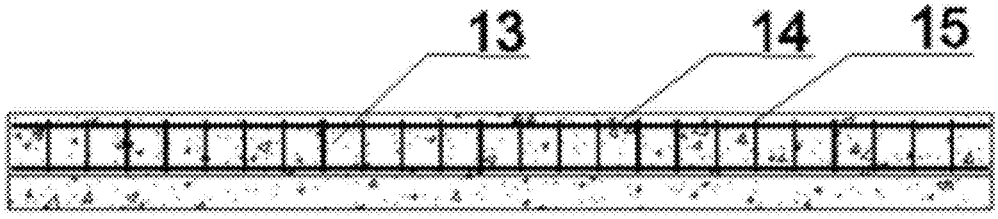
Figure 7:
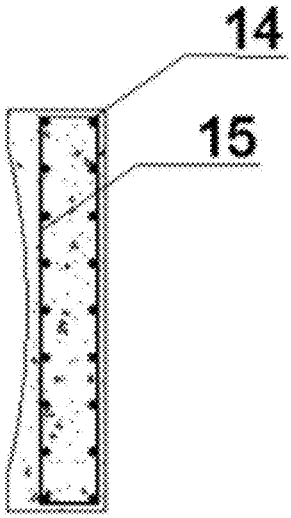
Figure 8:
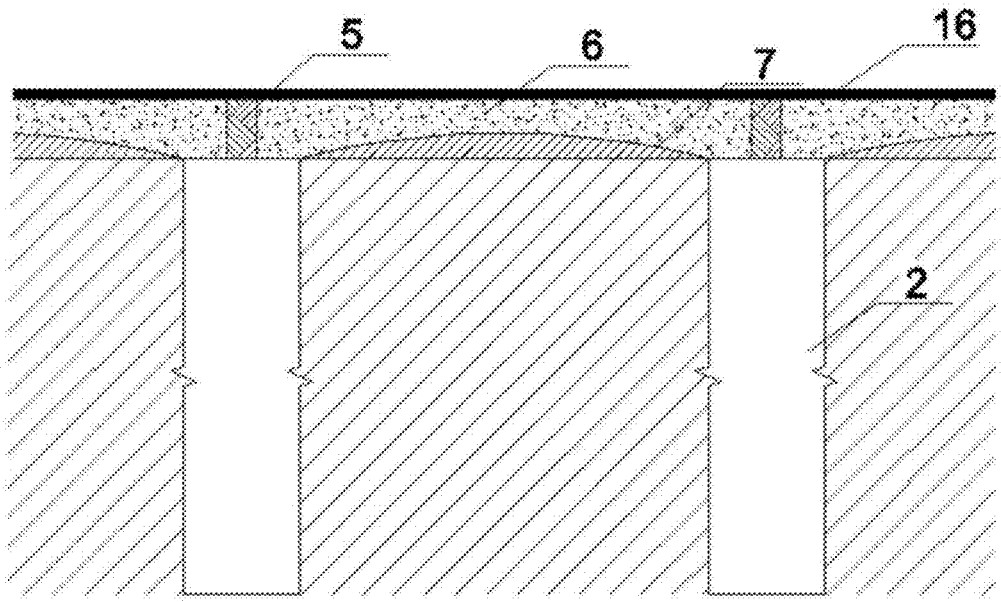
FIG. 8 is a schematic diagram of arranging the micro-bending slabs.

As shown in FIG. 7 (*a*), FIG. 7 (*b*), and FIG. (c), the micro-bending slab 6 is a prefabricated reinforced concrete slab, and a lower part of the micro-bending slab 6 facing toward the two adjacent arch sheets is arched, which can effectively reduce weight of the micro-bending slab 6. A total width of supporting parts on both sides of a bottom of the micro-bending slab 6 is calculated by an arch radius minus a width of an expansion joint. Steel bars in the micro-bending slab 6 include longitudinal load-bearing steel bars 14 and stirrups 15. A number of the steel bars is determined by specific stress conditions.

Figure 3:
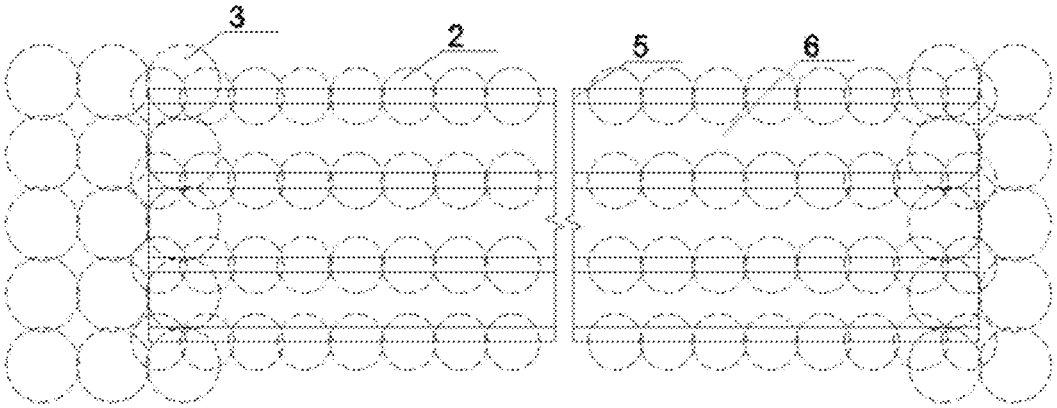
FIG. 3 is a distribution diagram of high-pressure rotary jet piles in the single span of the concealed arch.
Figure 4:
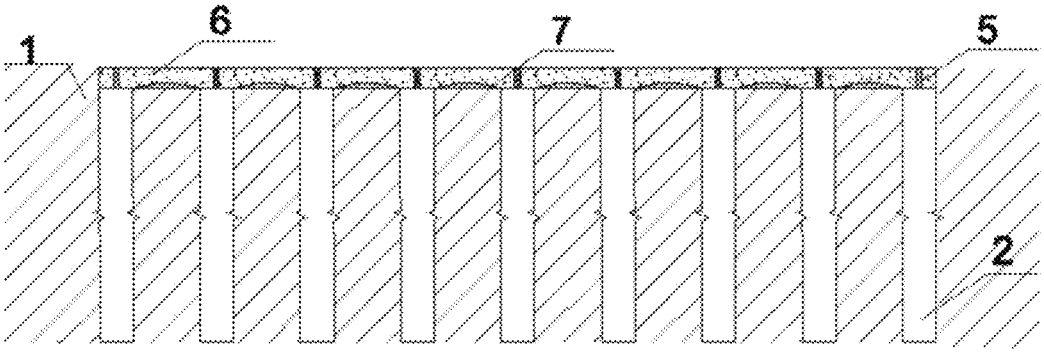
FIG. 4 is a cross section of the concealed arch.
Figure 5:
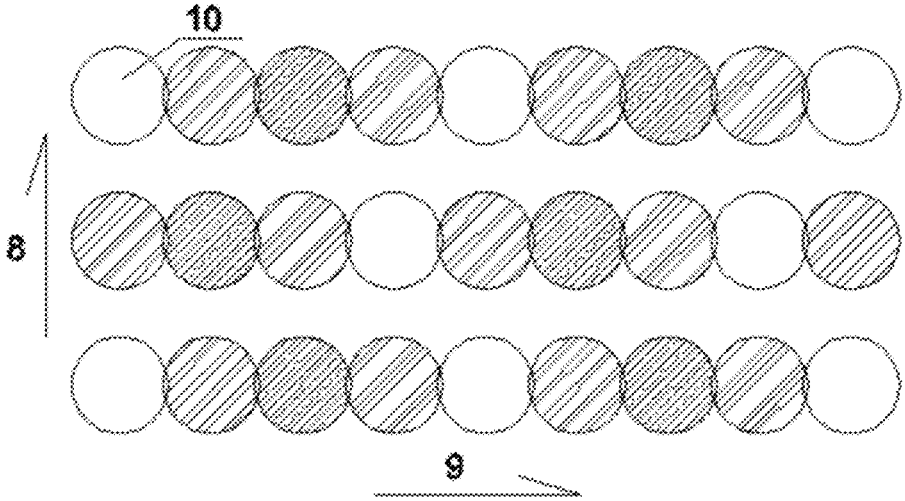
FIG. 5 is a schematic diagram of pile jumping construction.

Each pile foundation of the multiple columns of pile foundations is a high-pressure rotary jet pile foundation, that is, the high-pressure rotary jet piles forming the pile foundation 3 as shown in FIG. 3. For a soil layer with a thickness not greater than 35 m and having a rock formation 4 in the soil layer, a bottom of the pile foundation is disposed on the rock formation 4. For the soil layer with a thickness greater than 35 m, the pile foundation is a friction pile.

Embodiment 2

A reinforcement method for the poor foundation reinforcement system based on underground concealed arch structures includes following steps:

step 1: pile foundation construction, including: determining a location of drilling holes, a diameter of high-pressure rotary jet piles forming a pile foundation 3, and a depth of the pile foundation into soil according to a construction design;

step 2: determining diameters of high-pressure rotary jet piles forming the arch ring 2, a number of the high-pressure rotary jet piles forming the arch ring 2 disposed along the transverse bridge direction and a center distance of two high-pressure rotary jet piles, performing high-pressure rotary jet pile construction on the arch ring to make the arch axis 11 of the arch ring to be the catenary;

step 3: connecting the pile foundations and the arch ring in the embedded manner, and using a drill machine to drive the high-pressure rotary jet piles on both sides of the arch ring into the pile foundation by a depth of 2 m to form a hingeless arch structure;

step 4: preparing micro-bending slabs 6 in factories, C25 concrete 13 (the C25 represents a strength grade of the concrete) is selected as a main material of the micro-bending slabs 6, and a shape of the micro-bending slabs 6 can reduce weight and improve stress conditions of the arch ring; filling soil before installation of the micro-bending slabs 6, installing the micro-bending slabs 6 after filling the soil, setting up the construction joint 5 between each two adjacent micro-bending slabs 6, and filling the concrete in the construction joint 5;

where the arch sheets and micro-bending slabs 6 are combined to form a double curved arch structure: the micro-bending slabs 6 are placed on the arch sheets, and the construction joint 5 is filled with the concrete, which is conducive to bearing the load and realizing a purpose of longitudinally crossing a poor foundation section; and step 5: paving bitumen pavement on the micro-bending slabs 6, adding crash barriers, and setting up road signs.

Since the disclosure uses a connection manner of the micro-bending slabs 6 composed of steel bars and concrete, the pavement structure can be simplified to only retain an asphalt mixture surface layer without setting a pavement base and a subbase.

Preferably, the high-pressure rotary jet pile construction in the step 2 includes:

step 2.1: leveling site, surveying and setting out;

step 2.2: drilling holes using a method of pile jumping construction after determining a location, numbering the high-pressure rotary jet piles, every three of the high-pressure rotary jet piles along a length direction being a sequence, performing construction of a next sequence after completing construction of high-pressure rotary jet piles of a same sequence 10; where the pile jumping construction can avoid the strength reduction caused by the interaction of the high-pressure rotary jet piles;

step 2.3: cleaning the drilled holes; spraying cement after cleaning the drilled holes, where the cement is the ordinary Portland cement with a strength grade not less than 42.5 MPa and a density not less than 500 kg/m, a water cement ratio of cement paste of the ordinary Portland cement is 1:1; a water pressure increases from small to a predetermined pressure during drilling the holes;

performing jet grouting using double pipe injection when the holes are drilled to a designated elevation; and grouting the cement paste and air simultaneously using a jet pump; a pressure of the jet pump is not less than 20 MPa, and an air flow pressure is not less than 0.7 MPa;

step 2.4: stopping grouting the cement paste immediately in case of grout spilling during the high-pressure rotary jet pile construction, and continue to perform the construction after initial setting of the cement paste; and step 2.5: using an overall construction sequence to perform the high-pressure rotary jet pile construction, where the overall construction sequence includes: constructing the pile foundations first, then constructing the arch sheets on both sides of the pile foundations, and finally constructing remaining arch sheets from the both sides of the pile foundations.

Embodiment 3

(I) Research on an Ultimate Span of an Arch Bridge

Required calculations of the disclosure are performed by referring to an ultimate span of a deck type hingeless concrete arch bridge.

1) Stress Analysis of the Arch Bridge Under Self-Weight.

For the deck arch bridge, when bending moment at the arch crown is ignored, a calculation formula of the horizontal thrust of the arch crown is as follows:

$$H = \frac{ql^2}{8f}$$

H—horizontal thrust of the arch crown, the unit is kilonewton (kN).

q—load concentration acting on the arch bridge, the unit is kN/m.

l—a span of the arch bridge, the unit is meter (m).

f—a rise height of the arch bridge, the unit is meter.

When the ultimate span is analyzed, ¼ section of arch span is taken as a research object.

Axial force at ¼ section of the arch span:

$$N = H \times \sqrt{1 + \left(\frac{2f}{l}\right)^2} = \frac{ql^2}{8f} \times \sqrt{1 + \left(\frac{2f}{l}\right)^2}$$

Structure self-weight q=γ×A, the axial force under the structure weight:

$$N = H \times \sqrt{1 + \left(\frac{2f}{l}\right)^2} = \frac{\gamma A l^2}{8f} \times \sqrt{1 + \left(\frac{2f}{l}\right)^2}$$

N—the axial force of the section, the unit is kN.

γ—bulk density of concrete, the unit is kN/m$^3$.

A—section area, the unit is m$^2$.

2) Allowable Stress Analysis of the Arch Bridge

A free Length of the deck type hingeless arch bridge:

$$l_0 \approx 0.36S = 0.36\left(1 + \frac{8f^2}{3l^2}\right)l$$

$l_0$—the free length of the deck type hingeless arch bridge, the unit is meter.

S—a total length of main arch, the unit is meter.

3) Ultimate Span of Concrete Arch Bridge Under the Self-Weight

When the stress under the self-weight is the same as the allowable stress:

$$\sigma = \frac{N}{A} = \frac{\gamma \times l^2}{8f} \times \sqrt{1 + \left(\frac{2f}{l}\right)^2} = \varphi[\sigma]$$

σ—section compressive stress, the unit is kN/m$^3$.

[σ]—allowable compressive stress of high-pressure rotary jet piles, the unit is kN/m$^3$.

φ—a stability reduction coefficient, the unit is kN/m$^3$.

The value of the stability reduction coefficient is determined by a rise-span ratio and a slenderness ratio, and value ranges of the stability reduction coefficient are shown in TABLE 1.

TABLE 1

The value ranges of the stability reduction coefficient

| Rise-span ratio | 1/7 | 1/6 | 1/5 |
|---|---|---|---|
| Stability reduction coefficient | 0.78~0.89 | 0.77~0.88 | 0.75~0.87 |

The ultimate span of the arch bridge under the self-weight:

$$l_{max} = \frac{8\varphi[\sigma]\frac{f}{l}}{\gamma \times \sqrt{1 + \left(\frac{2f}{l}\right)^2}}$$

Taking the rise-span ratio of the arch bridge and the strength of the high-pressure rotary jet pile as variables to calculate an ultimate span range of the arch bridge. The results are shown in TABLE 2.

TABLE 2

Theoretical ultimate Span of a single arch

| Rise-span ratio | Strength of the high-pressure rotary jet pile (MPa) | | | |
|---|---|---|---|---|
| | 7 | 8 | 9 | 10 |
| 1/7 | 215~247 | 246~282 | 276~317 | 307~353 |
| 1/6 | 251~288 | 286~329 | 322~370 | 358~411 |
| 1/5 | 300~345 | 343~394 | 386~443 | 429~493 |

(II) Soft Soil Foundation Treatment

In this embodiment, soft soil foundation of a Class II highway with a length of 300 m and an average depth of 35 m is designed for foundation treatment (after a calculation, the depth of the soft soil foundation is set to 35 m, and the depth of a pile end into the soil is 40 m).

The rise-span ratio of the arch bridge is selected as ⅙, and the pile strength (also referred to a material strength of a high-pressure rotary jet pile, and the high-pressure rotary jet pile can be called pile as short) is designed as 7 MPa. According to (I) research on an ultimate span of an arch bridge, the ultimate span of the single arch of the concealed arch is about 250 m under theoretical conditions. In order to ensure safety of the project, the concealed arch in this embodiment selects a span having a length of 100 m and a third-class span structure (see FIG. 1-FIG. 3). The bridge deck width is 15 m, and the lane form is designed as two-way four-lane, the average bulk density of the cement soil is 20 kN/m$^3$, and the average bulk density of the arch ring is 22 kN/m$^3$. Both pile foundations and piles of the arch ring are constructed by jumping pile construction (see FIG. 5), the pile foundations at the combination part of two spans is composed of three columns of high-pressure rotary jet piles, and the side span pile foundation is composed of two columns of high-pressure rotary jet piles, as shown in FIG. 3, the cement is an ordinary Portland cement with strength no less than 42.5 MPa, the diameter of the pile foundation is 0.8 m, the pile length of the pile foundation is designed to be 15 m, the buried depth of the pile foundation is 40 m, and the depth of the pile end of the pile foundation into the rock is 5 m. The arch ring is designed as a constant cross-section catenary arch, the piles along the bridge direction 9 form arch sheets, and multiple arch sheets are connected to form an arch ring through the upper prefabricated concrete bridge decks (i.e., prefabricated reinforced concrete slabs). The diameter of each of the piles of the arch ring is 0.6 m, the length range of the piles of the arch ring is from 7 m to 25 m (see FIG. 1), and a center distance between two adjacent piles of the arch ring is 0.5 m. Nine piles of the arch ring are arranged along a transverse bridge direction 8, and a center distance between the two adjacent piles of the arch ring along the transverse bridge direction 8 is 1.8 m.

1) Check the Material Strength of the Main Section of the Arch Ring:

According to JGJ79-2012 "Technical Code for Ground Treatment of Buildings", the characteristic value formula of vertical bearing capacity of a single high-pressure rotary jet pile is:

$$R_a = \eta \cdot f_{cu,k} \cdot A_P$$

$$R_a = \pi \cdot d \sum_{i=1}^{n} l_i \cdot q_{si} + A_P \cdot q_p$$

$A_p$—pile section area of high-pressure rotary jet pile, the unit is $m^3$.

$R_a$—characteristic value of vertical bearing capacity of the single high-pressure rotary jet pile, the unit is kN.

$f_{cu}$, κ—average compressive strength of the reinforced soil test block under the same mix ratio in 28 days, the unit is kPa.

η—pile strength reduction factor.

d—a diameter of the high-pressure rotary jet pile, the unit is meter.

$l_i$—the soil has n layers, $l_i$ represents the thickness of the i-th soil layer, and the unit is meter.

$q_{si}$ characteristic value of lateral resistance of the i-th soil layer, the unit is kPa.

$q_p$—characteristic value of resistance at a pile end, the unit is kPa.

The smaller value of the two formulas is taken as the calculation result. According to the calculation of the above formulas, the bearing capacity of the single high-pressure rotary jet pile with a diameter of 0.6 m can reach 700 kN, and the bearing capacity of the single high-pressure rotary jet pile with a diameter of 0.8 m can reach 900 kN.

The calculation formula of vehicle converted load is $$h_0 = \frac{\sum Q}{\gamma B_0 L}$$

In this formula:

$h_0$—converted thickness, the unit is meter.

$\Sigma_Q$—total weight of wheels, the unit is kN.

γ—bulk density of filled soil, the unit is $kN/m^3$.

$B_0$—load width, the unit is meter.

L—load length, the unit is meter.

The axial force, bending moment and shear force of arch crown section and arch foot section are calculated.

The strength checking formula of the normal section is $N_j \leq \alpha A R_\alpha^j / r_m$ $N_j$—Average axial force calculated by ultimate state combination of bearing capacity, the unit is kN.

$$\alpha = \frac{1 - \left(\frac{e_0}{y}\right)^8}{1 + \left(\frac{e_0}{r_w}\right)^2},$$

α represents an eccentric influence coefficient of longitudinal force, and α is a dimensionless value. $e_0$ represents an eccentricity of the center of gravity of the section, and the unit is meter. y is a distance from the center of gravity of the converted section to the center of gravity axis in an eccentric direction, and the unit is meter.

$$r_w = \sqrt{\frac{I}{A}},$$

$r_w$ represents a radius of gyration of the converted section, and the unit is meter. I represents section moment of inertia, the unit is $m^4$.

A—normal section area, the unit is $m^2$.

$R_a^j$—designed compressive strength of the arch, the unit is MPa.

$r_m$—safety coefficient.

It is calculated that the designed compressive strength of the arch ring must be greater than 5.0 MPa, and the strength of the high-pressure rotary jet pile meets the design requirements. It is verified that the shear strength of the arch ring meets the requirements.

2) Checking Calculation of Bearing Capacity of the Pile Foundation.

A total vertical load on a single high-pressure rotary jet pile is:

$$N_h = [R_a] = \sum_{i=1}^{n} q_{ik} l_i + A_p m_0 \lambda \{[f_{ao}] + k_2 \gamma_2 (h_3 - 3)\}$$

$N_h$—the total vertical load on the single high-pressure rotary jet pile, the unit is kN.

$m_0$—proportional coefficient of vertical resistance coefficient of foundation at the pile end, $m_0$ is approximately equal to m, that means $m_0$=m in the above formula.

λ—correction coefficient.

$f_{ao}$—basic allowable value of bearing capacity of soil at the pile end, the unit is kPa.

$k_2$—correction coefficient of foundation bearing capacity with depth.

$\gamma_2$—weighted average weight of each soil layer above the pile end, the unit is $kN/m^3$.

$h_3$—buried depth of the pile end, the unit is meter.

$q_{ik}$—pile side resistance, the unit is kN.

Through the calculation, the bearing capacity of pile section, crack width and longitudinal horizontal displacement of pile top all meet the construction requirements.

3) Overall Construction Steps:

step 1: taking the construction of a mid-span of the concealed arch as an example (see FIG. 3): performing pile foundation construction first, and a diameter of the pile foundation is 0.8 m (see FIG. 6);

step 2: selecting the pile of the arch ring with a diameter of 0.6 m, where nine piles are arranged along the transverse bridge direction 8, and a center distance between the two adjacent piles along the transverse bridge direction 8 is 1.8 m; a construction quantity of the piles shall be determined according to the span along the bridge direction, and a center distance between the two adjacent piles along the bridge direction 9 is 0.5 m (see FIG. 3 and FIG. 5, there is a certain overlap between the two adjacent high-pressure rotary jet piles along the bridge direction 9, which can be achieved by setting the drilling position and diameter in the high-pressure rotary jet pile construction); a diameter of the side span pile is consistent with that of the main span, and the diameter of each of piles at the connection of the two spans is 0.8 m;

step 3: paving an upper part of the arch ring with prefabricated reinforced concrete slabs with a length of 4200 millimeters (mm) and a width of 1700 mm, forming the prefabricated reinforced concrete slabs into micro-bending slabs 6; designing a number of steel bars in the micro-bending slabs 6 according to the specific construction requirements, filling the soil before installing the prefabricated reinforced concrete slabs, and then paving bitumen pavement on the micro-bending slabs 6 directly; and step 4: adding crash barriers and setting up road signs.

The above embodiments are some of embodiments of the disclosure. It should be noted that those ordinary skilled in the art can make several improvements and refinishes without departing from the principles of the disclosure. These improvements and refinishes should also be considered as the protection scope of the disclosure.

What is claimed is:

1. A poor foundation reinforcement system based on underground concealed arch structures, comprising: a plurality of columns of pile foundations, arranged along a bridge direction;

wherein each two adjacent columns of pile foundations of the plurality of columns of pile foundations are provided therebetween with a plurality of arch sheets in parallel, and each of the plurality of arch sheets comprises high-pressure rotary jet piles arranged along the bridge direction;

wherein each two adjacent arch sheets of the plurality of arch sheets are connected by a micro-bending slab disposed on the two adjacent arch sheets, the plurality of arch sheets are connected by micro-bending slabs to together form an arch ring for bearing a load on the arch ring, and a construction joint is disposed between each two adjacent micro-bending slabs of the micro-bending slabs;

wherein the plurality of arch sheets are arranged in parallel along a transverse bridge direction, lengths of the high-pressure rotary jet piles of the plurality of arch sheets at a same position along the transverse bridge direction are the same, lengths of the high-pressure rotary jet piles of each of the plurality of arch sheets along the bridge direction are different from each other, and an arch axis of the high-pressure rotary jet piles along the bridge direction is a catenary;

wherein the two adjacent columns of pile foundations of the plurality of columns of pile foundations and the arch ring are connected in an embedded manner, and the high-pressure rotary jet piles on both sides of the arch ring are driven into and connected rigidly to the two adjacent columns of pile foundations of the plurality of columns of pile foundations;

wherein the micro-bending slab is a prefabricated reinforced concrete slab, and a lower part of the micro-bending slab facing toward the two adjacent arch sheets is arched; and wherein the micro-bending slab is provided with longitudinal load-bearing steel bars and stirrups.

2. The poor foundation reinforcement system based on underground concealed arch structures according to claim 1, wherein a diameter of each of the high-pressure rotary jet piles of each of the plurality of arch sheets is in a range of 0.6-0.8 meters (m).

3. The poor foundation reinforcement system based on underground concealed arch structures according to claim 2, wherein a material of each of the high-pressure rotary jet piles of the arch ring is an ordinary Portland cement with a strength grade not less than 42.5 megapascals (MPa).

4. The poor foundation reinforcement system based on underground concealed arch structures according to claim 1, wherein each pile foundation of the plurality of columns of pile foundations is a high-pressure rotary jet pile;

for a soil layer with a thickness not greater than 35 m and having a rock formation in the soil layer, a bottom of the pile foundation is disposed on the rock formation; and for the soil layer with a thickness greater than 35 m, the pile foundation is a friction pile.

5. A reinforcement method for the poor foundation reinforcement system based on underground concealed arch structures according to claim 4, comprising:

step 1: pile foundation construction, comprising: determining a location of drilling holes, a diameter of the pile foundation, and a depth of the pile foundation into soil according to a construction design;

step 2: determining diameters of the high-pressure rotary jet piles of the arch ring, a number of the high-pressure rotary jet piles of the arch ring disposed along the transverse bridge direction and a center distance of two high-pressure rotary jet piles of the high-pressure rotary jet piles of the arch ring, performing high-pressure rotary jet pile construction on the arch ring to make the arch axis of the arch ring to be the catenary;

step 3: connecting the pile foundations and the arch ring in the embedded manner, and using a drill machine to drive the high-pressure rotary jet piles on both sides of the arch ring into the pile foundation by a depth of 2 m to form a hingeless arch structure;

step 4: preparing the micro-bending slabs in factories, filling soil under positions for installing the micro-bending slabs before installation of the micro-bending slabs, installing the micro-bending slabs after filling the soil, setting up the construction joint between each two adjacent micro-bending slabs, and filling concrete in the construction joint; and step 5: paving bitumen pavement on the micro-bending slabs, adding crash barriers besides the bitumen pavement, and setting up road signs besides the bitumen pavement.

6. The reinforcement method for the poor foundation reinforcement system based on underground concealed arch structures according to claim 5, wherein the performing high-pressure rotary jet pile construction in the step 2 comprises:

step 2.1: leveling a site, and performing surveying and setting out;

step 2.2: drilling holes using a method of pile jumping construction after determining a location, numbering the high-pressure rotary jet piles, every three of the high-pressure rotary jet piles along a length direction being a sequence, performing construction of a next sequence after completing construction of a same sequence;

step 2.3: cleaning the drilled holes; spraying cement into the drilled holes after cleaning the drilled holes, wherein the cement is an ordinary Portland cement with a strength grade not less than 42.5 MPa and a density not less than 500 kg/m, a water cement ratio of cement paste of the ordinary Portland cement is 1:1; wherein a water pressure increases gradually to a predetermined pressure during drilling the holes; performing jet grouting on the drilled holes using double pipe injection when the holes are drilled to a designated elevation; and grouting the cement paste and air simultaneously to the drilled holes using a jet pump, wherein a pressure of the jet pump is not less than 20 MPa, and an air flow pressure is not less than 0.7 MPa;

step 2.4: stopping grouting the cement paste to the drilled holes in case of leaking the cement paste from the drilled holes during the high-pressure rotary jet pile construction, and continue to perform the high-pressure rotary jet pile construction after initial setting of the cement paste; and step 2.5: using an overall construction sequence to perform the high-pressure rotary jet pile construction, wherein the overall construction sequence comprising: constructing the pile foundations first, then constructing the arch sheets on both sides of the pile foundations, and finally constructing remaining arch sheets from the both sides of the pile foundations.

* * * * *